US011262114B2

(12) United States Patent
Begarelli

(10) Patent No.: US 11,262,114 B2
(45) Date of Patent: Mar. 1, 2022

(54) SYSTEM FOR DEICING AN EXTERNAL EVAPORATOR FOR HEAT PUMP SYSTEMS

(71) Applicant: BEGAFROST S.R.L., Verolavecchia (IT)

(72) Inventor: Bruno Begarelli, Verolavecchia (IT)

(73) Assignee: BEGAFROST S.R.L., Verolavecchia (IT)

( * ) Notice: Subject to any disclaimer, the term of this patent is extended or adjusted under 35 U.S.C. 154(b) by 619 days.

(21) Appl. No.: 16/092,284

(22) PCT Filed: Apr. 4, 2017

(86) PCT No.: PCT/EP2017/057930

§ 371 (c)(1),
(2) Date: Oct. 9, 2018

(87) PCT Pub. No.: WO2017/178275

PCT Pub. Date: Oct. 19, 2017

(65) Prior Publication Data

US 2020/0348059 A1 Nov. 5, 2020

(30) Foreign Application Priority Data

Apr. 11, 2016 (IT) ..... 102016000036760

(51) Int. Cl.
*F25B 47/02* (2006.01)
*F25B 49/02* (2006.01)
*F25B 41/20* (2021.01)

(52) U.S. Cl.
CPC ..... *F25B 47/022* (2013.01); *F25B 41/20* (2021.01); *F25B 49/02* (2013.01); *F25B 2600/2501* (2013.01)

(58) Field of Classification Search
CPC ..... F25B 47/022; F25B 41/20; F25B 49/02; F25B 2600/2501; F25B 2500/26;
(Continued)

(56) References Cited

U.S. PATENT DOCUMENTS 4,646,539 A 3/1987 Taylor
4,727,726 A 3/1988 Mitani et al.
(Continued)

FOREIGN PATENT DOCUMENTS

CN 101517323 A 8/2009
CN 204593991 U 8/2015
(Continued)

OTHER PUBLICATIONS

Sakagami, Refrigerator, May 16, 1989, JPH01123966A, Whole Document (Year: 1989).*
(Continued)

*Primary Examiner* — Larry L Furdge
(74) *Attorney, Agent, or Firm* — Cantor Colburn LLP

(57) ABSTRACT

A system for deicing an external evaporator for heat pump systems includes at least one compressor, at least one internal condenser, at least one external evaporator, at least one liquid separator, and a system of ducts for cooling fluid. The deicing system includes a secondary refrigeration circuit, which includes a tank for storing a heat transfer fluid, and a first heat exchanger immersed in the heat transfer fluid and adapted to transfer heat to the heat transfer fluid by cooling the cooling fluid. The system further includes a bypass refrigeration circuit, which includes the tank, and a second heat exchanger immersed in the heat transfer fluid and adapted to absorb heat from the heat transfer fluid by heating the cooling fluid. The system also includes a deicing circuit adapted to convey cooling fluid.

10 Claims, 1 Drawing Sheet

(58) Field of Classification Search
CPC ..... F25B 2600/2519; F25B 1/04; F25B 5/02; F25B 6/02; F25B 2400/24
See application file for complete search history.

(56) References Cited

U.S. PATENT DOCUMENTS

| | | | | |
|---|---|---|---|---|
| 4,869,074 | A | 9/1989 | Hoshi et al. | |
| 4,918,933 | A * | 4/1990 | Dyer | F24H 4/00 62/79 |
| 2015/0191182 | A1 | 7/2015 | Abou Eid et al. | |
| 2015/0354837 | A1 * | 12/2015 | Asthana | F25B 39/04 454/204 |

FOREIGN PATENT DOCUMENTS

| | | | | |
|---|---|---|---|---|
| EP | 2623896 | A1 | | 8/2013 |
| JP | S5467841 | U | | 5/1979 |
| JP | S5488952 | U | | 6/1979 |
| JP | S63116073 | A | | 5/1988 |
| JP | H01123966 | A | * | 5/1989 |
| JP | H01306755 | A | * | 12/1989 |
| JP | H1151503 | A | * | 2/1999 |
| JP | 2011058650 | A | * | 3/2011 |

OTHER PUBLICATIONS

Taki, Ice Heat Storage Type Refrigerating Device, Mar. 24, 2011, JP2011058650A, Whole Document (Year: 2011).*

Nakamura et al., Cooling Apparatus, Feb. 26, 1999, JPH1151503A, Whole Document (Year: 1999).*

Kawahara, Defrosting Control Method for Heat Pump Type Air Conditioner, Dec. 11, 1989, JPH01306755A, Whole Document (Year: 1989).*

International Search Report dated Jul. 6, 2017 re: Application No. PCT/EP2017/057930, pp. 1-4, citing: U.S. Pat. No. 4,727,726 A, U.S. Pat. No. 4,869,074 A, EP 2 623 896 A1, US 2015/191182 A1 and U.S. Pat. No. 4,646,529 A.

IT Search Report dated Dec. 21, 2016 re: Application No. IT UA20162463, pp. 1-7, citing: U.S. Pat. No. 4,727,726 A, U.S. Pat. No. 1,869,074 A, EP 2 623 896 A1, US 2015/191182 A1 and U.S. Pat. No. 4,646,539 A.

Written Opinion dated Jul. 6, 2017 re: Application No. PCT/EP2017/057930, pp. 1-5, citing: U.S. Pat. No. 4,727,726 A and U.S. Pat. No. 4,869,074 A.

JP Office Action dated Feb. 16, 2021 re: Application No. 2018-552650, pp. 1-4, citing: JP S63-116073 A, JP S54-67841 U and JP S54-38952 U.

* cited by examiner

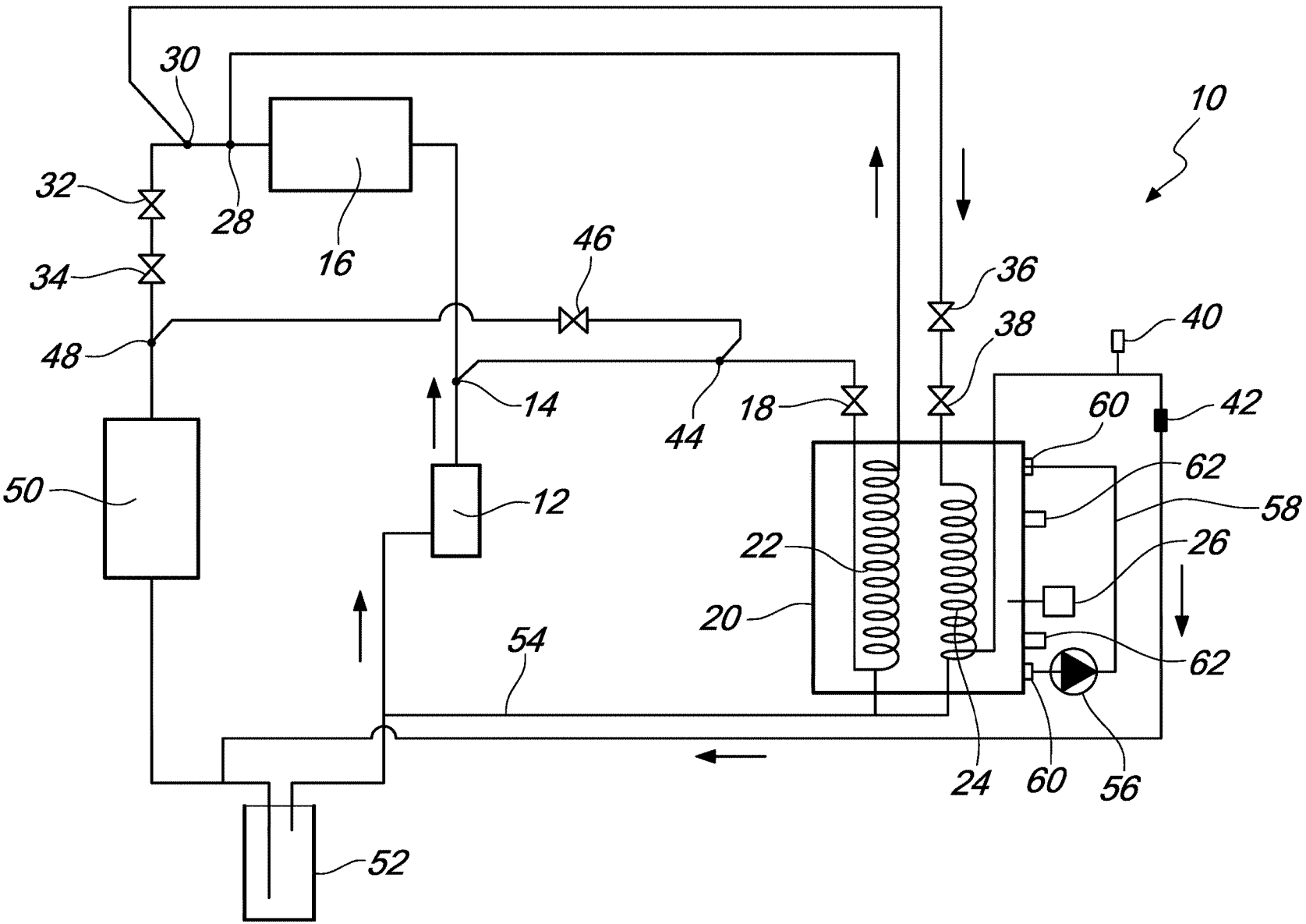
10
40
42
58
62
26
62
56
60
60
36
38
24
18
22
20
44
46
14
12
54
16
52
28
30
32
34
48
50

SYSTEM FOR DEICING AN EXTERNAL EVAPORATOR FOR HEAT PUMP SYSTEMS

TECHNICAL FIELD

The present disclosure relates to a system for deicing an external evaporator for heat pump systems, particularly, although not exclusively, useful and practical in the area of air conditioning systems adapted to heat or cool residential, commercial or industrial buildings.

BACKGROUND

If a heat pump system, such as for example an air conditioning system, is configured to operate as a heater, the corresponding exchanger or radiator installed in the external environment will operate as an evaporator and, for this reason, the temperature of its surface is fairly low.

When the external air is cold as well, typically during winter, with varying percentages of humidity, frost or ice will form on the surface of the external evaporator, causing a consequent reduction in the efficiency of the heat exchange, mainly owing to the insulating capacity of the ice and to the decrease in the spacing between the fins of the external evaporator.

In essence, if the external radiator or exchanger operating as an evaporator is not periodically defrosted, the operation, and also the efficacy and efficiency, of the heat pump system will be negatively and considerably affected.

In general, when the layer of frost or ice on the external evaporator is excessive, the power of the heat pump system will be reduced, the evaporation pressure of the cooling fluid will be modified, and malfunctions can arise, such as for example:

- a possible return of coolant gas in the liquid phase during suction by the compressor, causing damage to or the total breakage thereof,
- constant and sudden triggering of the deicing system, causing a waste of energy;
- a very low output of warm air from the internal exchanger operating as a condenser;
- a drastic lowering of the performance coefficient (up to 30%) from the performance specifications given by the maker.

The aim of the deicing cycle, also known as the defrosting cycle, is therefore to melt such frost or ice that has formed on the surface of the external evaporator; it can be carried out with different methods, according to the type of system and the different requirements.

The method of deicing that is used the most, in particular in the field of air conditioning, takes advantage of the possibility to combine both the heating function and the cooling function in a single heat pump, thus making it possible to proceed with the periodic deicing of the external evaporator by way of a cycle inversion, which makes it possible to make the high-temperature cooling fluid originating from the compressor, typically in the form of a gas, pass into the external evaporator to be deiced.

In conventional heat pump systems, such as for example conventional air conditioning systems, a reversible valve, typically a 4-way reversing valve, temporarily inverts the cycle of the cooling fluid so as to change the direction of the flow of heat, in order to melt this layer of ice; in this way the roles are also inverted of the external radiator, which passes from acting as an evaporator to acting as a condenser, and of the internal radiator, which passes from acting as a condenser to acting as an evaporator.

Therefore, in a deicing cycle, the cooling fluid evaporates in the internal radiator and condenses in the external radiator, the internal and external ventilations stop, so as to reduce the heat energy necessary for the deicing, and the compressor compresses gas at high temperature in the external radiator, thus making it possible to melt the ice that has formed.

In general, conventional heat pump systems have two or three deicing cycles per hour, which are executed at an external air temperature of +4÷5° C. and as a function of the humidity present.

Obviously, while the heat pump is in this deicing step, the internal radiator cools the air that is intended for example for the rooms of a building to be heated, and therefore there is a necessity to heat the air before putting it into circulation (this is known as preheating).

One of the biggest problems relates to the correct adjustment of the frequency of the deicing cycles. In fact, infrequent deicing cycles lead to the formation of ice very often on the surface of the external evaporator, worsening the heat exchange efficiency; while over-frequent deicing cycles lead to the introduction of cold air into the air conditioning system, with negative effects on the wellbeing of the end users, and energy waste, for example owing to frequent cooling fluid cycle inversions or to repeated preheating operations.

The adjustment of the duration of the deicing cycles is also strategic to the complete melting of the frost or ice that has formed on the external exchanger operating as an evaporator. In fact, if the deicing step is too short, not all of the frost or ice that is present on the external evaporator will be melted, and the remaining part tends to solidify more thickly and compactly when the deicing step ends and operation returns to the heating step.

SUMMARY

The aim of the present disclosure is to overcome the limitations of the known art described above, by devising a system for deicing an external evaporator for heat pump systems which makes it possible to obtain better effects and/or similar effects at lower cost with respect to those obtainable with conventional solutions, thus making it possible to completely replace the deicing step during the operation of the system, i.e. to avoid carrying out periodic deicing cycles that interrupt operation of the apparatus as a heating system.

Within this aim, the present disclosure provides a system for deicing the external evaporator for heat pump systems which makes it possible to avoid frequent cooling fluid cycle inversions, and also repeated preheating operations.

The present disclosure devises a system for deicing the external evaporator for heat pump systems which makes it possible to spare the apparatus from conditions of excessive stress, in this manner ensuring greater reliability of the mechanical and electrical parts, especially over the long term of service, and a consequent reduction of the number of maintenance operations necessary.

The present disclosure conceives of a system for deicing the external evaporator for heat pump systems which makes it possible to increase performance in terms of absorptions, in heating mode (SCOP).

The present disclosure devises a system for deicing the external evaporator for heat pump systems which makes it possible to increase performance in terms of absorptions, in cooling mode (SEER).

The present disclosure also provides a system for deicing the external evaporator for heat pump systems that is highly reliable, easily and practically implemented and low cost.

This aim and these and other advantages which will become better apparent hereinafter are achieved by providing a system for deicing an external evaporator for heat pump systems, said heat pump system comprising at least one compressor, at least one internal condenser, at least one external evaporator, at least one liquid separator, and a system of ducts for cooling fluid, said deicing system being characterized in that it comprises:

- a secondary refrigeration circuit, connected in input and in output to said heat pump system and adapted to convey cooling fluid, which comprises a tank for storing a heat transfer fluid, and a first heat exchanger immersed in said heat transfer fluid and adapted to transfer heat to said heat transfer fluid by cooling said cooling fluid;
- a bypass refrigeration circuit, connected in input and in output to said heat pump system and adapted to convey cooling fluid, which comprises said tank, and a second heat exchanger immersed in said heat transfer fluid and adapted to absorb heat from said heat transfer fluid by heating said cooling fluid; and
- a deicing circuit connected in input and in output to said heat pump system and adapted to convey cooling fluid.

BRIEF DESCRIPTION OF THE DRAWING

Further characteristics and advantages of the disclosure will become better apparent from the description of a preferred, but not exclusive, embodiment of the system for deicing the external evaporator for heat pump systems according to the disclosure, which is illustrated by way of non-limiting example in the accompanying drawing wherein:

FIG. 1 is a block diagram of an embodiment of the system for deicing the external evaporator for heat pump systems, according to the present disclosure.

DETAILED DESCRIPTION OF THE DRAWING

With reference to FIG. 1, the system for deicing the external evaporator for heat pump systems according to the disclosure, generally designated by the reference numeral 10, will be described below in the case where such system is integrated directly in a conventional heat pump system, for example an air conditioning system.

A conventional heat pump system comprises substantially at least one compressor 12, at least one internal exchanger 16 operating as a condenser, hereinafter also referred to as an internal unit or internal condenser, at least one external exchanger 50 operating as an evaporator, hereinafter also referred to as an external unit or external evaporator, at least one liquid separator 52, and a system of ducts for interconnection between the components, i.e. for conveying cooling fluid in gaseous or liquid state.

The compressor 12 of the heat pump system compresses the cooling fluid in the form of a gas and puts it into the circuit, activating the circulation thereof in the gaseous state, at high pressure and at high temperature.

By way of a three-way or Y connection 14 (entry point), arranged after the compressor 12, a first portion of coolant gas is redirected to a secondary refrigeration circuit, connected in input (connection 14) and in output (connection 28) to the heat pump system, while a second portion of coolant gas proceeds along the normal primary refrigeration circuit of the heat pump system, in particular toward one or more internal units 16 operating as condensers, installed in the rooms of the building to be heated.

The first portion of coolant gas, which as mentioned is redirected to the secondary refrigeration circuit, proceeds toward a first two-way, two-position opening flow control valve 18, for example of the on/off type.

The operation, i.e. the opening and the closing, of the first opening flow control valve 18 is controlled, for example, on the basis of the values of the outer and inner ambient temperature, of the inflow and outflow temperature of the coolant gas, of the humidity in contact with one or more external units 50 operating as evaporators, or of the temperature of a heat transfer fluid inside a tank 20, such values being measured by adapted probes or sensors. Furthermore, the operation of the first opening flow control valve 18 is controlled as a function of the needs of the context.

For example, for measuring the value of the temperature of the heat transfer fluid and the consequent opening or closing of the first opening flow control valve 18, the tank 20 comprises an immersion thermostat 26, preferably with adjustment of temperature comprised between 0 and 80° C.

After passing the first opening flow control valve 18, the coolant in the gaseous phase enters a first heat exchanger 22, which preferably comprises a spiral capillary tube made of copper, contained in a tank 20.

By way of the first heat exchanger 22, the heat of the coolant gas is transferred to a heat transfer fluid, such as for example water, which is stored in the tank 20, which therefore acts as a condenser, the first heat exchanger 22 being immersed, preferably totally, in the aforementioned heat transfer fluid.

At the output from the first exchanger 22, i.e. as a consequence of the transfer of heat and of the consequent cooling by the coolant, the coolant has changed state from gaseous to liquid by way of the latent heat and it is therefore in the liquid phase, at medium temperature and average pressure, essentially a sub-cooled liquid.

The coolant liquid is then conveyed to a three-way or T connection 28 (outflow point), arranged after the internal condenser 16, which allows the reinsertion of the coolant liquid into the normal primary refrigeration circuit.

Based on a ratio between the temperature and the humidity of the external environment, and the temperatures of coolant gas delivery and coolant liquid return, in input to or in output from the external evaporator 50 and the internal condenser 16, or based on preset times, the system 10 for deicing the external evaporator for heat pump systems according to the disclosure will activate itself in order to stop the formation of incipient frost or ice as soon as it starts.

When the activation conditions above are met, a second two-way, two-position opening flow control valve 34, for example of the on/off type, closes. The second opening flow control valve 34 is arranged after a first throttle valve 32, preferably electronic. Both of these valves 32 and 34 are arranged between the connection 28 or 30 and the connection 48.

By way of a three-way or Y connection 30 (entry point), arranged after the internal condenser 16, the coolant liquid, which was directed toward the evaporator or external unit 50, is redirected to a bypass refrigeration circuit, connected in input (connection 30) and in output (separator 52) to the heat pump system.

The redirected coolant liquid proceeds toward a third two-way, two-position opening flow control valve 36, for example of the on/off type, which in turn on opening sends it to a second throttle valve 38, preferably electronic, which handles the expansion and the correct sub-cooling of the coolant liquid, now expanded, by making a ratio between pressure and temperature, which are detected respectively by at least one pressure transducer 40 and by at least one temperature probe 42, preferably in contact.

The expanded coolant liquid then enters a second heat exchanger 24, which preferably comprises a spiral capillary tube made of copper, by way of which the heat of the heat transfer fluid is transferred the coolant, which evaporates at a positive temperature, the second heat exchanger 24 being in immersed, preferably totally, in the aforementioned heat transfer fluid.

Note that at this point the heat transfer fluid stored in the tank 20 is at high temperature, since it was previously heated by way of the first heat exchanger 22.

At the output from the heat exchanger 24, i.e. after the absorption of heat and the consequent heating by the coolant, the coolant has changed state from liquid to gaseous by way of the latent heat and it is therefore in the gaseous phase.

Note that the pressure transducer 40 and the temperature probe 42 are both arranged or installed downstream of the second heat exchanger 24.

The coolant gas is then conveyed to a liquid separator 52 (outflow point), which ensures a normal and correct intake, as a consequence preventing the occurrence of any slugging of liquid to the compressor 12.

At this point, the evaporator or external unit 50 is completely empty, since the coolant liquid originating from the condenser or internal unit 16 is evaporating inside the bypass refrigeration circuit, and therefore it is possible to clean the external evaporator 50 from formations of frost or ice, and completely curb the critical phase.

By way of a three-way or Y connection 44 (entry point), arranged between the connection 14 and the first opening flow control valve 18, and with the closing of the latter, the first portion of coolant gas is redirected to a deicing circuit, connected in input (connections 14 and then 44) and in output (connection 48) to the heat pump system.

The redirected gas proceeds toward a fourth opening flow control valve 46, for example electronically opened or even of the on/off type.

Once open, the fourth opening flow control valve 46 allows the passage of the coolant gas toward the evaporator 50, which at this moment is unused, deciding according to an algorithm or a preset time to which evaporator to send the coolant gas if there are multiple evaporators per external unit.

The insertion of the coolant gas into the evaporator 50 occurs by way of a three-way or Y connection 48 (exit point), advantageously arranged after the first throttle valve 32 in order to have a constant flow that is as rapid as possible.

From inside the evaporator 50, the coolant gas that has passed through the deicing circuit dissipates its heat, thus preventing any formation of frost or ice and keeping the conventional air conditioning system stable without arrests and swings in operation.

As soon as the evaporator or external unit 50 is in optimal conditions, i.e. completely free from frost or ice on its surface, it will return to performing its work and the system 10 for deicing the external evaporator for heat pump systems according to the disclosure, and in particular the corresponding bypass circuit and deicing circuit, will remain on standby until a new formation of frost or ice.

In the system 10 for deicing the external evaporator for heat pump systems according to the disclosure, the 4-way reversing valve is permanently under tension with no possibility of inverting the cycle of the cooling fluid, since it never passes from the cooling mode to the heating mode for the deicing cycle.

In a preferred embodiment, the system 10 for deicing the external evaporator for heat pump systems according to the disclosure comprises a gravity system 54 between at least one of the heat exchangers 22 and 24 and the liquid separator 52, for example provided by way of capillary tubes or tubing in general, so as to not have problems with the equalization of oil and to always have a constant return.

In a preferred embodiment of the system 10 for deicing the external evaporator for heat pump systems according to the disclosure, the tank 20 of heat transfer fluid comprises a circulation duct 58 provided with a circulation pump 56, in order to not have stratifications of heat inside the tank 20 proper.

Installation of the circulation duct 58 on the tank 20 occurs by way of at least one pair of couplings 60, preferably threaded.

In a possible embodiment of the system 10 for deicing the external evaporator for heat pump systems according to the disclosure, the tank 20 of heat transfer fluid comprises at least one pair of couplings 62, preferably threaded, one referred to as the heating delivery coupling and the other as the heating return coupling, in order to be able to integrate and/or connect an additional heat source, such as for example a boiler, in addition to the heat pump machine.

In a different embodiment of the system for deicing the external evaporator for heat pump systems according to the disclosure, such system can be connected externally to a heat pump system, for example a conventional conditioning system. In such case, the deicing system according to the disclosure is in practice constituted by a prefabricated kit, assembled in a single enclosure.

In practice it has been found that the disclosure fully achieves the set aims and advantages. In particular, it has been seen that the system for deicing the external evaporator for heat pump systems thus conceived makes it possible to overcome the qualitative limitations of the known art, since it makes it possible to completely substitute the step of deicing during the operation of the system, i.e. to avoid the periodic execution of deicing cycles that interrupt the operation of the system in heating mode.

Another advantage of the system for deicing the external evaporator for heat pump systems according to the disclosure is that, by avoiding the periodic execution of deicing cycles, in essence it consequently eliminates the inversions of the cycle of the cooling fluid (the 4-way valves are never inverted) and the preheating operations.

Compared to conventional solutions, the system for deicing the external evaporator for heat pump systems according to the disclosure is more efficient in energy terms, since it needs less energy in order to obtain the same level of heating, in particular with the continuous production of energy for the internal environment, and it enables the cleaning of the external evaporator from frost or ice without interruption of flows and of energy generated.

Furthermore, compared to conventional solutions, the system for deicing the external evaporator for heat pump systems according to the disclosure is cheaper in economic terms, since a significant reduction in the energy costs is obtained for a modest increase in the production costs of the system.

Another advantage of the system for deicing the external evaporator for heat pump systems according to the disclosure is that it makes it possible to spare the apparatus from conditions of excessive stress, in this manner ensuring greater reliability of the mechanical and electrical parts, especially over the long term of service, and a consequent reduction of the number of maintenance operations necessary.

Another advantage of the system for deicing the external evaporator for heat pump systems according to the disclosure is that it makes it possible to increase performance in terms of absorptions, both in heating mode (SCOP) and in cooling mode (SEER).

Although the system for deicing the external evaporator for heat pump systems according to the disclosure has been devised in particular for use in air conditioning systems adapted to heat or cool residential, commercial or industrial buildings, it can also be used, more generally, for employment in any apparatus or system that comprises a heat pump machine, the external evaporator of which is subject to the formation on its surface of frost or ice, in particular in heating mode when it operates as an evaporator.

The disclosure, thus conceived, is susceptible of numerous modifications and variations, all of which are within the scope of the appended claims. Moreover, all the details may be substituted by other, technically equivalent elements.

In practice, the materials used, as well as the contingent shapes and dimensions, may be any according to the requirements and the state of the art.

The disclosures in Italian Patent Application No. 102016000036760 (UA2016A002463) from which this application claims priority are incorporated herein by reference.

The invention claimed is:

1. A system for deicing an external evaporator for heat pump systems, said heat pump system comprising at least one compressor, at least one internal condenser, at least one external evaporator, at least one liquid separator, and a system of ducts for cooling fluid, said system comprising:

a secondary refrigeration circuit, connected in input and in output to said heat pump system and adapted to convey cooling fluid, which comprises a tank for storing a heat transfer fluid, and a first heat exchanger immersed in said heat transfer fluid and adapted to transfer heat to said heat transfer fluid by cooling said cooling fluid, said secondary refrigeration circuit being connected in input downstream of said compressor and in output downstream of said internal condensor;

a bypass refrigeration circuit, connected in input and in output to said heat pump system and adapted to convey cooling fluid, which comprises said tank, and a second heat exchanger immersed in said heat transfer fluid and adapted to absorb heat from said heat transfer fluid by heating said cooling fluid, said bypass refrigeration circuit being connected in input downstream of said internal condenser and upstream of said external evaporator, and in output into said liquid separator; and a deicing circuit connected in input and in output to said heat pump system and adapted to convey cooling fluid.

2. The system for deicing the external evaporator for heat pump systems according to claim 1, wherein said secondary refrigeration circuit and/or said bypass refrigeration circuit and/or said deicing circuit comprise a two-way, two-position opening flow control valve.

3. The system for deicing the external evaporator for heat pump systems according to claim 1, wherein said bypass refrigeration circuit comprises a throttle valve.

4. The system for deicing the external evaporator for heat pump systems according to claim 1, wherein said bypass refrigeration circuit comprises at least one pressure transducer arranged downstream of said second heat exchanger.

5. The system for deicing the external evaporator for heat pump systems according to claim 1, wherein said bypass refrigeration circuit comprises at least one temperature probe arranged downstream of said second heat exchanger.

6. The system for deicing the external evaporator for heat pump systems according to claim 1, further comprising a gravity system between at least one of said first and second heat exchangers and said liquid separator.

7. The system for deicing the external evaporator for heat pump systems according to claim 1, wherein said tank comprises an immersion thermostat.

8. The system for deicing the external evaporator for heat pump systems according to claim 1, wherein said tank comprises a circulation duct fitted with a circulation pump.

9. The system for deicing the external evaporator for heat pump systems according to claim 1, wherein said tank comprises at least one pair of couplings, a heating delivery coupling and a heating return coupling.

10. The system for deicing the external evaporator for heat pump systems according to claim 1, wherein at least one of said first and second heat exchangers comprises a spiral capillary tube made of copper.

* * * * *